US009389009B2

(12) United States Patent
Olson, Jr. et al.

(10) Patent No.: US 9,389,009 B2
(45) Date of Patent: Jul. 12, 2016

(54) ICE MAKING MACHINE EVAPORATOR WITH JOINED PARTITION INTERSECTIONS

(71) Applicant: Manitowoc Foodservice Companies, LLC., Manitowoc, WI (US)

(72) Inventors: William Eugene Olson, Jr., Manitowoc, WI (US); Gerald William Wendt, Manitowoc, WI (US); Raymond Randy Haack, Mishicot, WI (US); John-Paul James Ishioye, Cleveland, WI (US)

(73) Assignee: Manitowoc Foodservice Companies, LLC, Manitowoc, WI (US)

( * ) Notice: Subject to any disclaimer, the term of this patent is extended or adjusted under 35 U.S.C. 154(b) by 0 days.

(21) Appl. No.: 14/458,559

(22) Filed: Aug. 13, 2014

(65) Prior Publication Data

US 2015/0114025 A1 Apr. 30, 2015

Related U.S. Application Data

(60) Provisional application No. 61/898,175, filed on Oct. 31, 2013.

(51) Int. Cl.
*B23P 15/26* (2006.01)
*F25C 1/24* (2006.01)

(52) U.S. Cl.
CPC ..... *F25C 1/246* (2013.01); *Y10T 29/49359* (2015.01)

(58) Field of Classification Search
CPC ..... F25C 1/24; F25C 1/246; F25C 1/243; Y10T 29/49396; Y10T 29/49359; Y10T 29/4935
USPC ..... 62/340
See application file for complete search history.

(56) References Cited

U.S. PATENT DOCUMENTS 2,849,869 A 9/1958 Baillif et al.
2,918,995 A * 12/1959 Kruger ..... E04C 2/423 217/31

(Continued)

FOREIGN PATENT DOCUMENTS

GB 1263452 A 2/1972
WO WO 2015065564 A1 * 5/2015 ..... F25C 1/246

OTHER PUBLICATIONS

International Search Report dated Dec. 18, 2014 for PCT application No. PCT/US2014/050880.

(Continued)

*Primary Examiner* — Essama Omgba
(74) *Attorney, Agent, or Firm* — Ohlandt, Greeley, Ruggiero & Perle, LLP

(57) ABSTRACT

Disclosed are methods and apparatuses for overcoming known plating deficiencies in evaporator assemblies in ice making machine. One embodiment joins the vertical and horizontal partitions together at their intersections so that all surfaces are susceptible for increased soldering/brazing by eliminating the "voids" by changing the location and design of the "weep holes" in the vertical and/or horizontal partitions. This provides more complete capillary path at the joint between the vertical and horizontal partitions and the evaporator pan allowing improved flow via capillary action of solder/brazing alloy during the joining of the assembled vertical and horizontal partition grid to the evaporator pan. Another embodiment increases the clearance between the partitions at their intersections to allow the post-joining plating treatment to penetrate and coat all the partition surfaces by widening the intersection slots in the partitions, but including "stand-off" features to center the mating partition in the widened intersection slot.

8 Claims, 8 Drawing Sheets

(56) References Cited

U.S. PATENT DOCUMENTS

| | | | | |
|---|---|---|---|---|
| 2,955,440 | A | 10/1960 | Erickson et al. | |
| 3,280,588 | A | 10/1966 | Brindley | |
| 3,340,341 | A * | 9/1967 | Bruder | B01J 19/32 156/308.2 |
| 5,193,357 | A | 3/1993 | Kohl et al. | |
| 6,681,580 | B2 * | 1/2004 | Shedivy | F25C 1/12 62/352 |

OTHER PUBLICATIONS

Written Opinion dated Dec. 18, 2014 for PCT application No. PCT/US2014/050880.

* cited by examiner

ICE MAKING MACHINE EVAPORATOR WITH JOINED PARTITION INTERSECTIONS

CROSS-REFERENCED APPLICATION

This application claims priority to U.S. Provisional Application Ser. No. 61/898,175, filed on Oct. 31, 2013, which is incorporated herein in its entirety by reference thereto.

BACKGROUND

1. Field of the Disclosure

The present disclosure generally relates to the design of ice making machine evaporator components and the joining process of the evaporator components. In particular, the present disclosure relates to the design and joining of ice making machine evaporator partitions having a crisscross pattern of partitions, and the joining of those partitions to an evaporator pan.

2. Discussion of the Background Art

Conventional ice making machines have an evaporator that is constructed using partitions assembled in a crisscross pattern (generally crisscrossed at about a 90° angle, hereinafter referred to as "horizontal" partitions and/or "vertical" partitions) and joined to an evaporator pan using only butt joints. The crisscross pattern forms individual vessels or cells where ice cubes are formed. On the side of the evaporator pan opposite the crisscross pattern of partitions is generally a serpentine refrigeration coil that chills the evaporator pan, providing an ice-forming surface on the crisscross side of the evaporator pan such that water cascading down the side having the partitions forming the cells will freeze and gradually build up within the cells, forming ice cubes. Once a sufficient amount of ice has formed in the cells, the ice cubes are harvested using a hot gas bypass circuit in the refrigeration system. During the harvest cycle in a conventional ice making machine, the hot gas warms the contact surface between the cubes and the evaporator pan and the cubes are released to fall into, e.g., a storage receptacle. Conventional ice making machine evaporators are constructed using a copper evaporator pan, copper partitions, and a copper serpentine tube or tubes.

The crisscross pattern of the partitions, as mentioned above, forms cells. These cells have four walls with an interior volume determined by the area (L×W) of the cell surface times the height/depth of the cell walls. The conventional design for the partitions forming the cells is to have a large aspect ratio (length or width to height, or L/W:H) with slots cut halfway across the height of each partition at locations where intersections between a horizontally disposed and a vertically disposed partition will form. As a result, the crossing (vertical and horizontal) partitions each make up slightly less than half the material height as they cross each other. The slots are of sufficient cross-sectional dimension to accommodate the width of the partition of the crossing partition that slides into it. However, the slot cross-sectional dimension is not so large that the crossing partition has "wobble" or "play" when inserted; this could result in problems concerning, e.g., the release of the ice slab/cubes during harvest and, due to the fact that water expands during freezing at certain temperatures, the deformation of the relative size of the cells by water freezing in the spacing provided by the "wobble" or "play", resulting in damage to the crisscross assembly and/or non-uniform cube size. Thus, the slots generally provide relatively close or no clearance for the width of the mating partition. For partitions that are running horizontally on a vertically disposed evaporator pan in the ice making machine, the slots are cut in the height of the partition an angle 90° to the length of the partition. For the partitions that are running vertically on a vertically disposed evaporator pan in ice making machine, the slots are cut in the height of the partition at an angle, nominally 75°, to the length of the partition. The effect of the 75° angle in the vertically disposed partitions is to put an approximately 15° downward tilt into the horizontally running partitions that fit into the slots in the vertically running partitions. This 15° downward tilt allows gravity to pull the frozen ice slab/cubes from the evaporator pan cells during the harvest cycle of the ice making machine.

Conventional partitions also include what are known as "weep holes" for the purpose of allowing air to move around behind the slab of ice during the harvest cycle. Without the ability for air to move from cube cell to cube cell behind the slab of ice, the harvest cycle of the ice making machine would be impaired due to a vacuum that would be formed as the slab of ice is pulled away from the evaporator pan by gravity. These "weep holes" are intentionally located in the vertical partitions at the evaporator pan side of the vertical and horizontal partition intersections in conventional ice making machines so that a single "weep hole" is located at the corners of four ice cube-forming cells. Stated otherwise, the "weep hole" is located on the evaporator pan contact point at the end of a centerline running parallel to the angle of the slots in the vertically disposed partition. When the horizontal partitions are joined with the angled slots of the vertical partitions, the open end of the slot on the horizontal partition joins or mates with the "weep hole" located on the evaporator pan contact point at the end of the above-described center line parallel to the angle of the slots on the vertically disposed partition. The result is that there is a "void" (or combined weep hole/slot opening) at the intersection of the vertical and horizontal partitions adjacent the evaporator pan. This "void" creates an area where the crisscrossed vertical and horizontal partitions do not contact the evaporator pan (i.e., the "weep holes").

The vertical and horizontal partitions are assembled together in a crisscross pattern and placed on the evaporator pan to form a grid that divides the ice cubes from each other. The evaporator pan is generally contoured so that the crisscross partition grid is disposed on a concave surface of the evaporator pan and the serpentine refrigeration/hot gas coil is disposed on a convex surface of the evaporator pan. This assembly (i.e., crisscross partition grid and concave surface of the evaporator pan) needs to be joined together and is usually joined during the manufacturing process, typically by soldering or brazing. The result of the joinder by soldering/brazing is that each partition (vertical and horizontal) in the grid is joined to the evaporator pan by many solder butt joints. The partitions are not joined to each other (being held together by the close or no clearance between the mated partitions), only to the evaporator pan surface. The serpentine refrigeration/hot gas coil is also typically soldered or brazed to the convex side of the evaporator pan.

Once the partitions and serpentine tubing are soldered or brazed to the evaporator pan, a coating is typically applied to the assembly to confer food grade safety and corrosion protection to it. This coating is typically a layer of nickel plating, generally either electrostatically or electroless, applied to the assembly. As mentioned above, the partition grid is generally assembled together with tight clearances between the slots and the width of the inserted partition to ensure that the partitions remain parallel to each other. Because of the tight or no clearance and potential lack of clearance between the partition surfaces at their intersections, the plating solutions do not always penetrate into the vertical and horizontal partition intersections and provide plating to all the surfaces forming the partition intersections. The reason for this is that the "void" (i.e., "weep hole") prevents capillary action from allowing the brazing or soldering alloy to wick into the tight clearance between the slot and the width of its mating partition. Without complete penetration, material forming the base materials of the evaporator pan and/or vertical and horizontal partitions may be left exposed.

SUMMARY

Thus, it is an object of the present disclosure to provide a design of partitions that allows for more complete coating of plating material thereto.

It is also an object of the present disclosure to provide a design of a partition-evaporator pan assembly that likewise allows for more complete coating of plating material thereto.

These and other objects will become apparent to those skilled in the art based on the present disclosure.

This disclosure provides two different representative solutions that can be used to accomplish the above objects. These two solutions may preferably be used independently of one another. While these two design approaches serve to reduce or prevent the potential for poor plating penetration at the partition intersections, other approaches and specific designs will become apparent to those skilled in the art based on the present disclosure.

The first solution joins the vertical and horizontal partitions together at their intersections where the intersections meet the evaporator pan surface so that the intersections are susceptible for more complete soldering/brazing. It does this by eliminating the above described "voids" by changing the location and design of the "weep holes" in the vertical and/or horizontal partitions. This change thus provides a more complete capillary path at the joint between the intersections of the vertical and horizontal partitions and the evaporator pan, and therefore allows for improved flow (or wicking) of molten solder or brazing alloy during the joining of the assembled vertical and horizontal grid and the evaporator pan. This design change allows the molten joining material to move from the evaporator pan into the intersections of the partitions through capillary action. This first approach also allows for the intersections of the partitions to be brazed or soldered shut to eliminate the areas of tight clearance or lack of clearance that may not be effectively plated during the plating process.

To accomplish the first approach of soldering or brazing the partition intersections shut, the present disclosure provides for a capillary path for the solder or brazing material at the contact area of the evaporator pan and the intersection point of the joint between the vertical and horizontal partitions. It has been discovered that the conventional location of the "weep holes" in the vertical partitions, forming "voids" with the ends of the slots in the horizontal partitions, prevents the solder or brazing material from wetting into the vertical and horizontal partition intersection joints. This disclosure relocates the "weep holes" in the evaporator partitions so as to be disposed away from the partition intersections. In doing this, the solder or brazing material is given a capillary path to join together the partitions at their intersections.

Therefore, one embodiment of the present disclosure comprises a partition for use in forming a crisscross grid capable of substantially completely contacting a substantially planar surface of an evaporator pan of an ice making machine, the partition comprising a length having two opposed edges, a height, a width and a plurality of substantially parallel slots disposed along a first one of the edges, each slot having a centerline, and at least one weep hole disposed proximal a second one of the edges and not disposed along a centerline.

Another embodiment of the present disclosure comprises a partition for use in forming a crisscross grid capable of substantially completely contacting a substantially planar surface of an evaporator pan of an ice making machine, the partition comprising a length having two opposed edges, a height, a width and a plurality of substantially parallel slots disposed along a first one of the edges and at least one weep hole disposed along the first one of the edges between two of the parallel slots.

A still further embodiment of the present disclosure comprises a crisscross grid comprised of a first plurality of substantially parallel partitions, each partition comprising a length having two opposed edges, a height, a width and a plurality of substantially parallel slots disposed along a first one of the edges, each slot having a centerline, and at least one weep hole disposed proximal a second one of the edges and not disposed along a centerline, and a second plurality of substantially parallel partitions, each partition comprising a length having two opposed edges, a height, a width and a plurality of substantially parallel slots disposed along a first one of the edges and at least one weep hole disposed along the first one of the edges between two of the parallel slots, wherein the first and second plurality are disposed substantially perpendicular to one another by engagement of the slots.

Another embodiment of the present disclosure comprises a crisscross grid comprised of a first plurality of substantially parallel partitions, each partition comprising a length having two opposed edges, a height, a width and a plurality of substantially parallel slots disposed along a first one of the edges, each slot having a centerline, and at least one weep hole disposed proximal a second one of the edges and not disposed along a centerline, and a second plurality of substantially parallel partitions, each partition comprising a length having two opposed edges, a height, a width and a plurality of substantially parallel slots disposed along a first one of the edges, wherein the first and second plurality are disposed substantially perpendicular to one another by engagement of the slots.

Yet another embodiment of the present disclosure comprises a crisscross grid comprised of a first plurality of substantially parallel partitions, each partition comprising a length having two opposed edges, a height, a width and a plurality of substantially parallel slots disposed along a first one of the edges and at least one weep hole disposed along the first one of the edges between two of the parallel slots, and a second plurality of substantially parallel partitions, each partition comprising a length having two opposed edges, a height, a width and a plurality of substantially parallel slots disposed along a first one of the edges, wherein the first and second plurality are disposed substantially perpendicular to one another by engagement of the slots.

The second solution increases the clearance between the partitions at their intersections to allow the post-joining plating treatment to penetrate and coat all the partition surfaces. This design change involves widening the intersecting slots in the partitions to a width greater than the width of a mating partition, but including "stand-off" features in those slots to center the mating partition in the widened intersecting slot. The result of this second approach is to enlarge the clearance between partitions to eliminate the areas of tight clearance or lack of clearance, yet maintain the intersection between mating partitions without "wobble" or "play".

To successfully accomplish the second approach of enlarging clearance between partitions at the intersections, two modifications to the conventional partition need to be made. The first modification is to widen the slot width in each of the vertical and horizontal partitions to allow for more clearance at the partition intersections for the width of the mating partition. The second modification is to add stand-off features inside the slots to keep the mating partition(s) centered within the slots. If the partitions slots were just widened, the mating partition would likely not stay centered within the slot. This would cause that partition to lean to one side of the slot, leading to an area of tight clearance at the intersection and defeating the purpose of widening the slot. It will also be appreciated and understood that the parallelism between partitions would not be maintained if the partitions were free to lean in different directions within the partition grid pattern.

Therefore, an embodiment of the present disclosure comprises a partition for use in forming a crisscross grid, the partition comprising a length having two opposed edges, a height, a partition width and a plurality of substantially parallel slots disposed along a first one of the edges, each slot having a centerline and at least one weep hole disposed proximal the other edge along the centerline, each slot having a first slot width wider than the partition width of a partition disposed therein for forming the crisscross grid, and each slot having at least two protrusions disposed on opposite sides inside of the slot width, the protrusions providing the slot with a second slot width substantially equal to the partition width of a partition disposed therein for forming the crisscross grid.

An additional embodiment of the present disclosure comprises a partition for use in forming a crisscross grid, the partition comprising a length having two opposed edges, a height, a partition width and a plurality of substantially parallel slots disposed along a first one of the edges, each slot having a first slot width wider than the partition width of a partition disposed therein for forming the crisscross grid, and each slot having at least two protrusions disposed on opposite sides inside of the slot width, the protrusions providing the slot with a second slot width substantially equal to the partition width of a partition disposed therein for forming the crisscross grid.

A still further embodiment of the present disclosure comprises a crisscross grid comprised of a first plurality of substantially parallel partitions, each of the first plurality of partitions comprising a length having two opposed edges, a height, a partition width and a plurality of substantially parallel slots disposed along a first one of the edges, each slot having a centerline and at least one weep hole disposed proximal a second one of the edges along the centerline, each slot having a first slot width wider than the partition width of a partition disposed therein for forming the crisscross grid, and each slot having at least two protrusions disposed on opposite sides inside of the slot width, wherein the protrusions provide the slot with a second slot width substantially equal to the partition width of a partition disposed therein for forming the crisscross grid, and a second plurality of substantially parallel partitions, each of the second plurality of partitions comprising a length having two opposed edges, a height, a partition width, and a plurality of substantially parallel slots disposed along a first one of the edges, each slot having a first slot width wider than the partition width of a partition disposed therein for forming the crisscross grid, and each slot having at least two protrusions disposed on opposite sides inside of the slot width, wherein the protrusions provide the slot with a second slot width substantially equal to the partition width of a partition disposed therein for forming the crisscross grid, wherein the first and second plurality are disposed substantially perpendicular to one another by engagement of the slots.

Any of the embodiments of either of the above two solutions will eliminate the potential for poor plating penetration at the partition intersections, prevent exposed partition material, and eliminate problems that could result from exposed partition material. The first approach accomplishes the desired benefits by eliminating areas where plating may not be complete at the intersection of the vertical and horizontal grid due to tight clearance or lack of clearance. The second approach accomplishes the desired benefits by a somewhat opposite methodology, i.e., widening the intersections where the vertical and horizontal partitions crisscross, to allow for fully effective plating of the areas otherwise difficult to plate completely.

Potential alternatives for the "weep holes" locations are included in the present disclosure. These alternatives include: (1) not putting "weep holes" in the design at all; (2) including "weep holes" as typical crescent shapes, as small slots, or as fully enclosed holes. Combinations of these alternatives will be further explained in connection with the discussion of the accompanying Figures. These alternatives accomplish the purpose of allowing capillary connection between the partition intersection joint and the evaporator pan contact points still including the "weep holes" in the design to allow air movement behind the ice slab during the harvest cycle. A representative design for widening the slots and enlarging slot clearance, and including stand-offs, is also included in the discussion of the accompanying Figures. Potential alternatives for the embodiment where the slot widths are widened to provide a first slot width greater than the partition width of a mating partition, and stand offs or protrusions are included inside the slot widths to provide a second slot width substantially equal to the partition width of a mating partition, is also included in the discussion of the accompanying Figures.

Further objects, features and advantages of the present disclosure will be understood by reference to the following drawings, detailed description and appended claims.

DETAILED DESCRIPTION OF THE PREFERRED EMBODIMENT

Figure 1A:
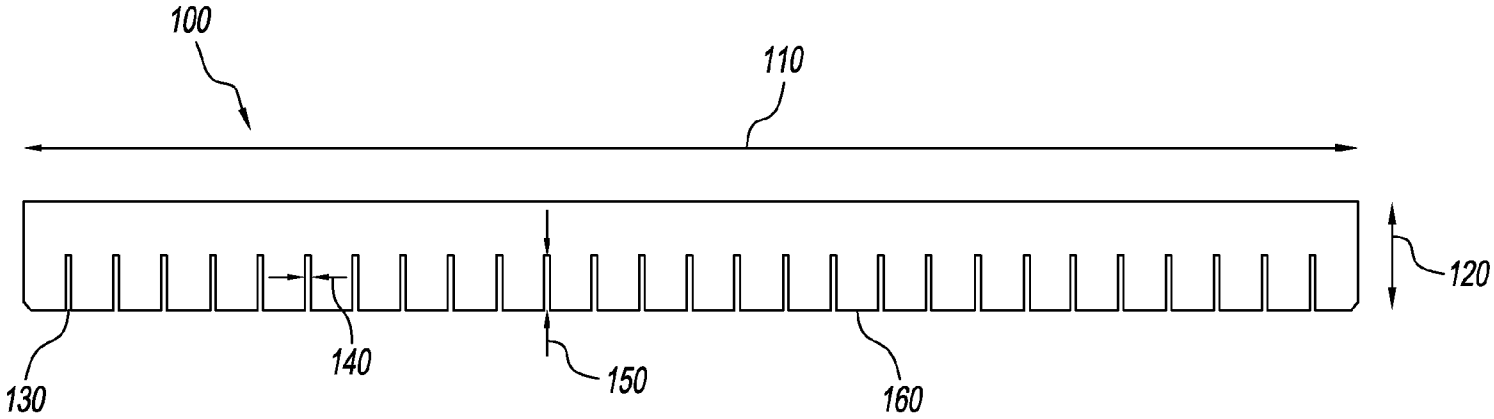
FIG. 1A (Prior Art)
FIGS. 1A and 1B provide side views of conventional horizontal and vertical partitions, respectively.

FIG. 1A shows a side view of a conventional horizontal partition 100. Conventional horizontal partition 100 has a length 110 and a height 120. Conventional horizontal partition 100 has a plurality of substantially equally spaced slots 130, each slot having a width 140 and a depth 150. Length 110 is approximately equal to the inside horizontal surface of a vertically disposed evaporator pan (not shown) to which it is affixed. Height 120 is approximately equal to the depth of a vertically disposed evaporator pan (not shown) to which it is affixed. Slots 130 are substantially equally spaced so as to provide substantially equally sized cells (when mated or joined with a vertical partition) for the formation of ice cubes. Slots 130 are also provided with a depth 150 that is, generally, approximately half the height 120 of horizontal partition 100 and vertical partition 170 (see, FIG. 1B) so that, when inserted into matching slot 130 in vertical partition 170 lower edge 160 of horizontal partition 100 is essentially coplanar with lower edge 160 of vertical partition 170 so that the lower edges 160 substantially completely contact the surface of an evaporator pan (not shown). Slots 130 also have width 140 such that width 140 provides a substantially tight fit with the width (not shown) of vertical partition 170 when horizontal partition 100 is slid into slots 130 of vertical partition 170.

Figure 1B:
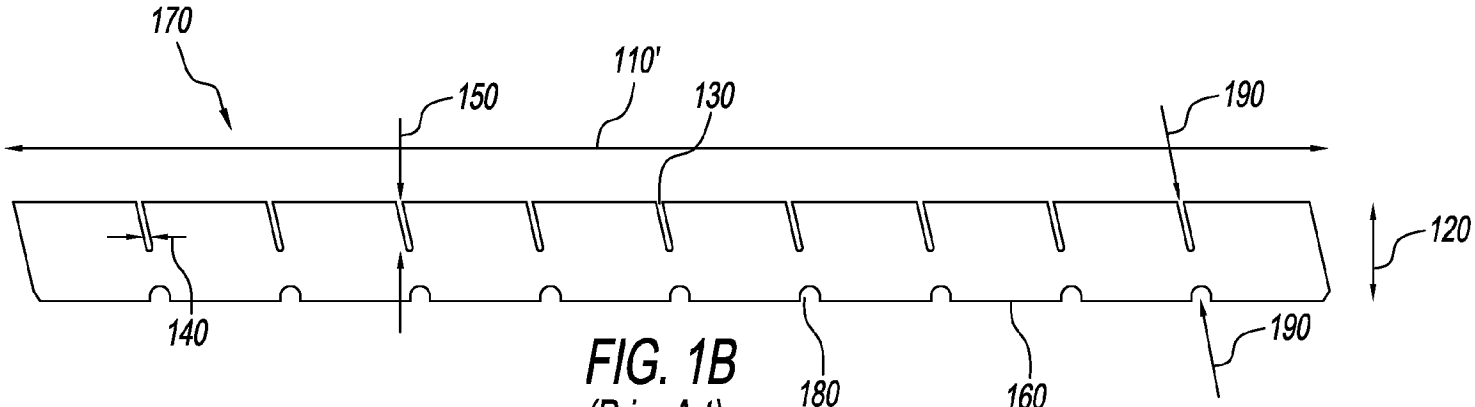
FIG. 1B (Prior Art)

FIG. 1B shows a side view of a conventional vertical partition 170. In FIG. 1B, elements 120, 130, 140, 150 and 160 are as described above with respect to horizontal partition 100. As can be seen in FIG. 1B, slots 130 disposed in vertical partition 170 are angled so as to provide a downward slope of about 15° to horizontal partition 100, as described above in paragraph [0003], when horizontal partition 100 is slid into place in vertical partition 170. Vertical partition 170 also has a series of weep holes 180, each of which is disposed along lower edge 160 of vertical partition 170 on a centerline 190 of each slot 130 of vertical partition 170. As can be envisioned, when horizontal partition 100 is mated (or joined) via engagement of slots 130 of horizontal partition 100 with slots 130 of vertical partition 170, the portion of slots 130 on horizontal partition that are disposed near lower edge 160 effectively mate (or join or match) with weep holes 180, thereby creating the "voids" and associated problems as described above in paragraph [4]. In FIG. 1B, length 110' of vertical partition 170 may be the same as or different than length 110 of horizontal partition 100. Length 110' will be equal to length 110 if the evaporator pan is of a square design or configuration. However, if the evaporator pan is of a rectangular design, length 110' will be different than length 110.

FIGS. 2A-2D show side views of various horizontal partitions according to the present disclosure. The horizontal partitions shown in FIGS. 2A-2D vary such that the horizontal partitions of FIGS. 2A and 2B will preferably be used in conjunction with the vertical partitions shown in FIGS. 3A-3D, while the horizontal partitions shown in FIGS. 2C-2D will preferably be used in conjunction with the vertical partitions shown in FIGS. 3E-3F. The various combinations of horizontal partitions and vertical partitions of FIGS. 2A and 2B and FIGS. 3A-3D according to the present disclosure will, therefore, be discussed separately below. As used herein with respect to the present disclosure, the term "weep hole" will be variously referred to, and shown, as weep hole slots, weep holes and weep hole through-holes. The weep holes will also take any of a number of various shapes, including but not limited to oval, circular, elliptical, rectangular, square, triangular, or any other geometry. Also, the size and number of the weep holes can be varied according to design choice and combinations of shapes and sizes may be used according to design choice. The options for weep holes shape, placement, size and number recited above can be used for vertical partitions and/or for horizontal partitions according to the present disclosure.

Figure 2A:
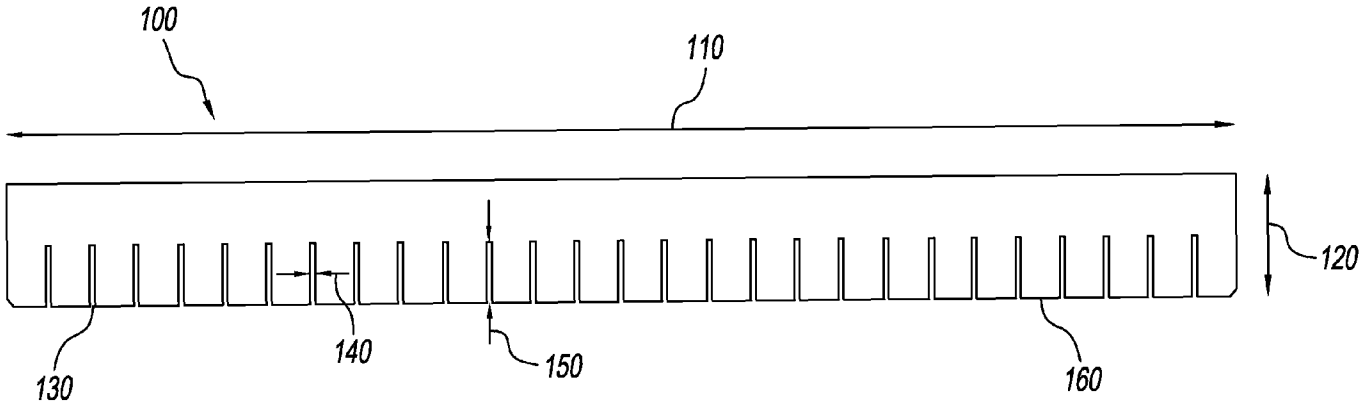
FIGS. 2A, 2B, 2C and 2D provide side views of alternate horizontal partitions, according to the present disclosure.
Figure 2B:
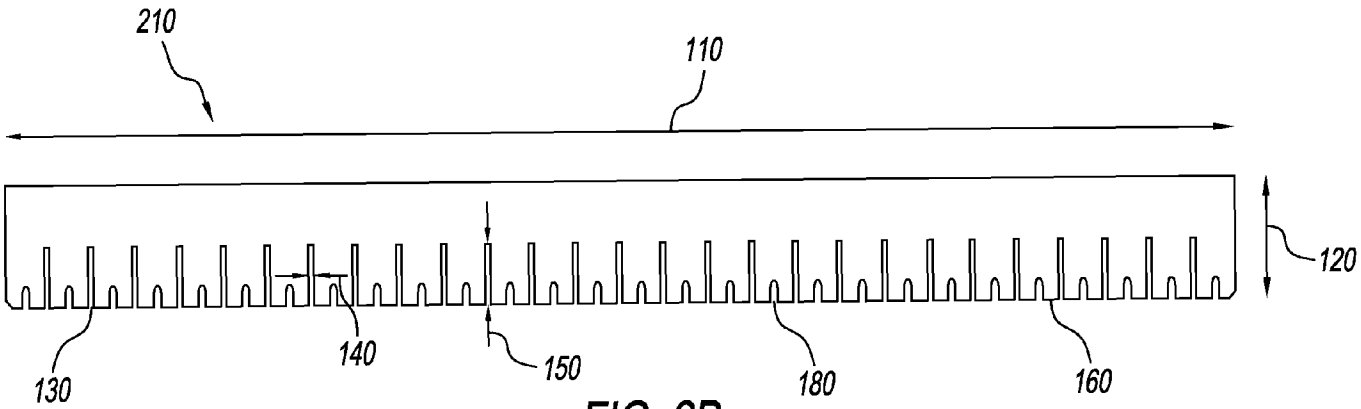

FIG. 2A shows a horizontal partition 100, which is essentially identical to conventional partition 100 shown in FIG. 1A. FIG. 2B shows horizontal partition 210 that is similar in design to horizontal partition 100, the difference being the addition of weep holes slots 180 disposed between slots 130 along lower edge 160. FIGS. 3A-3D show vertical partitions 310, 320, 330 and 340 that are substantially similar to vertical partition 170 shown in FIG. 1B. Vertical partition 310 differs from vertical partition 170 in that vertical partition 310 does not have any weep holes 180. Vertical partitions 320, 330 and 340 differ from the vertical partition 170 in that vertical partitions 320, 330 and 340 have weep holes placed away from centerline 190 of vertical partitions 320, 330 and 340. Weep holes 180 of vertical partitions 320, 330 and 340 are depicted as being substantially midway between adjacent centerlines 190; however, the specific placement of weep holes 180 away from centerlines 190 is a mere matter of choice. Also, although in vertical partitions 320, 330 and 340 a single weep hole 180 is shown as being disposed between each pair of adjacent centerlines 190, a plurality of such weep hole slots 180 may be so disposed, so long as each weep hole slot 180 is disposed away from a centerline 190. Similarly, although weep hole slot 180 in vertical partition 320 is shown as a semicircle and weep hole slot 180 in vertical partition 330 is shown as a longitudinal slot, these configurations are merely exemplary in nature, and the weep hole slots 180 can be of any geometry, or combinations thereof on any individual vertical partition. Likewise, although weep hole slots 180 in vertical partition 340 are depicted as a relatively oval in shape, the through-hole(s) forming weep holes slots 180 can be of any configuration, including circular, elliptical, rectangular, square, triangular, or any other geometry. Also, the size of weep holes 180 can be varied according to design choice. The options for weep holes 180 shape, placement, size and number recited above for vertical partitions 320, 330 and 340 apply as well to weep holes 180 present in horizontal partitions 210, 220 and 230.

Figure 3A:
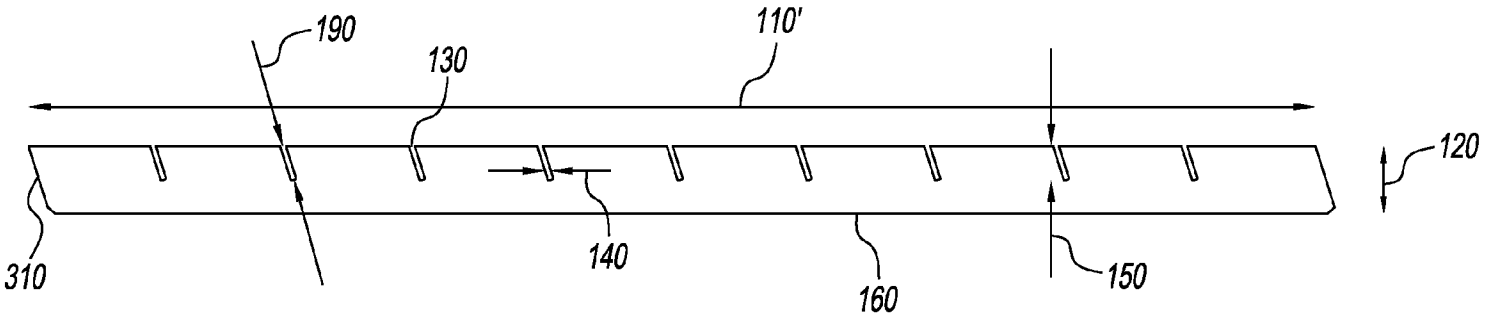
FIGS. 3A, 3B, 3C, 3D, 3E and 3F provide side views of alternate vertical partitions, according to the present disclosure.
Figure 3B:
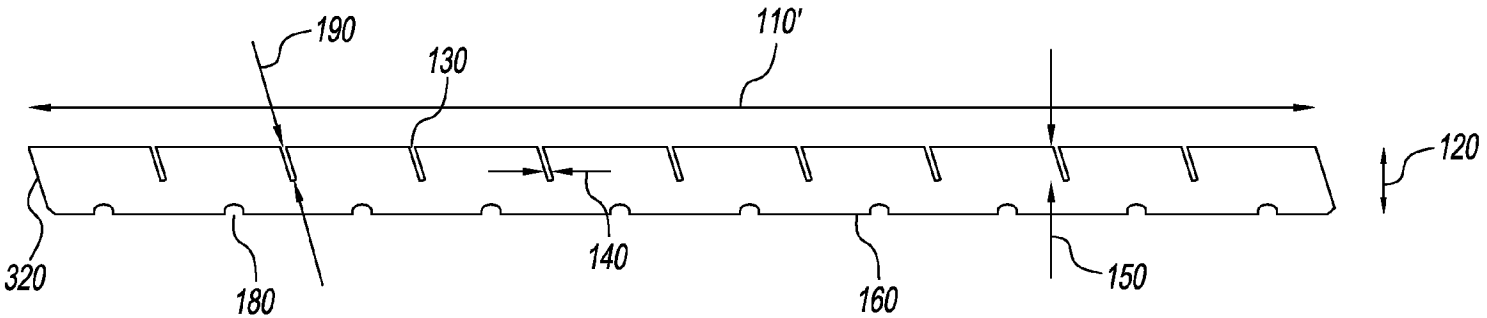
Figure 3C:
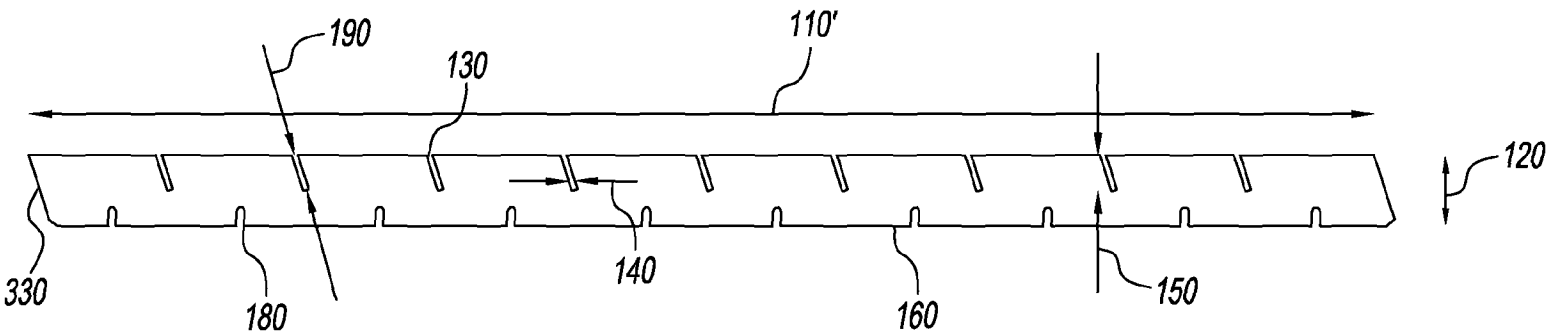
Figure 3D:
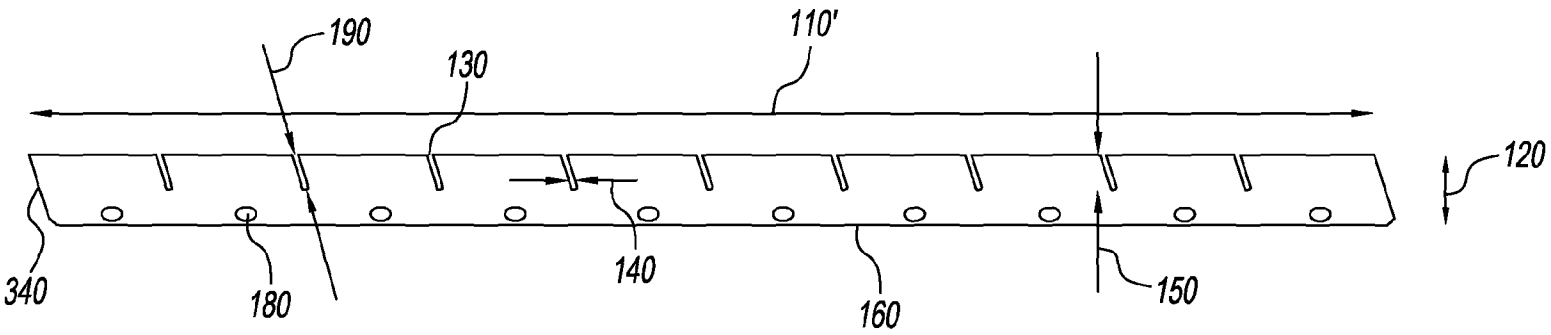

Turning now to the configurations of vertical and horizontal partitions as assembled, horizontal partition 100 can be used with any of vertical partitions 320, 330 or 340 shown in FIGS. 3B-3D. As will be appreciated, when horizontal partition 100 is mated or joined to any of vertical partitions 320, 330 or 340, lower edges 160 of horizontal partition 100 and vertical partitions 320, 330 and 340 will be essentially coplanar. As a result, individual cells for forming ice cubes will be created, each cell having 2 weep holes 180 along the evaporator pan side of the cells on each vertical edge of the cell. There will be no weep holes 180 along the horizontal edge of these cells. At the same time, lower edges 160 of horizontal partition 100 and vertical partitions 320, 330 and 340 will substantially completely contact the surface of an evaporator pan, providing for complete wicking of the brazing or soldering material into the intersection of horizontal partition 100 and vertical partitions 320, 330 and 340. When horizontal partition 210 of FIG. 2B is similarly assembled with vertical partitions 320, 330 and 340 similar results are attained with additional weep holes 180 along the horizontal edges of the individual ice cube cells due to the presence of weep holes 180 in horizontal partition 210. When horizontal partition 210 is used in conjunction with vertical partition 310, the result is similar to that of the combination of horizontal partition 100 with any of vertical partitions 320, 334 and 340, the difference being that the combination of horizontal partition 210 with vertical partition 310 results in weep holes 180 being present along the horizontal edges of the ice cube cells.

Figure 2C:
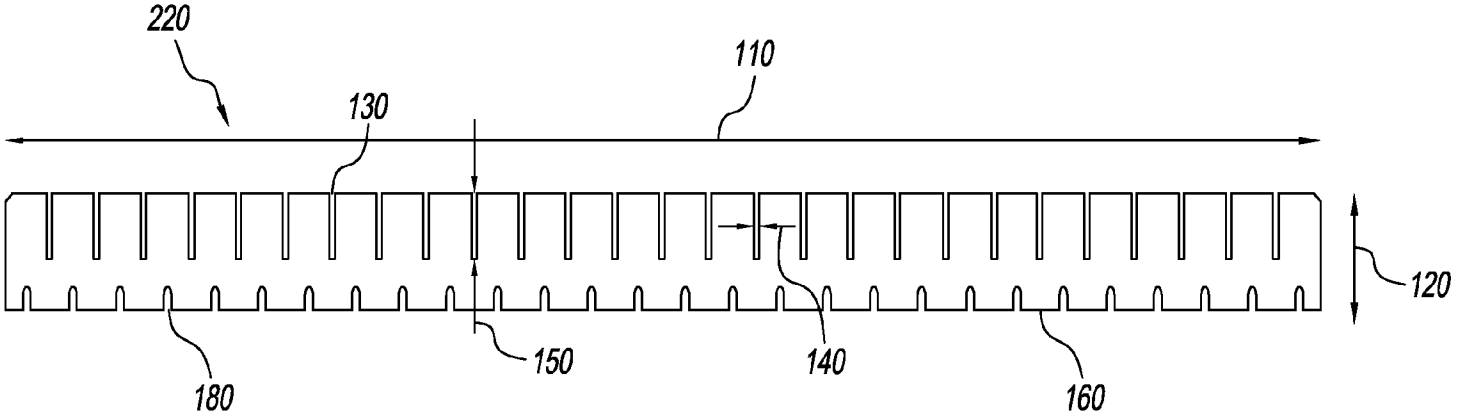
Figure 2D:
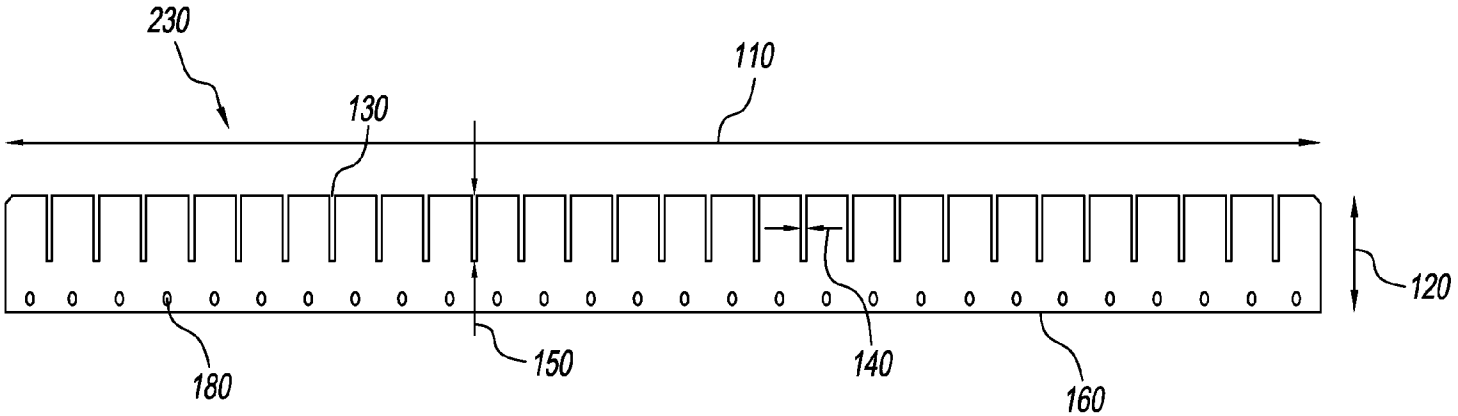
Figure 3E:
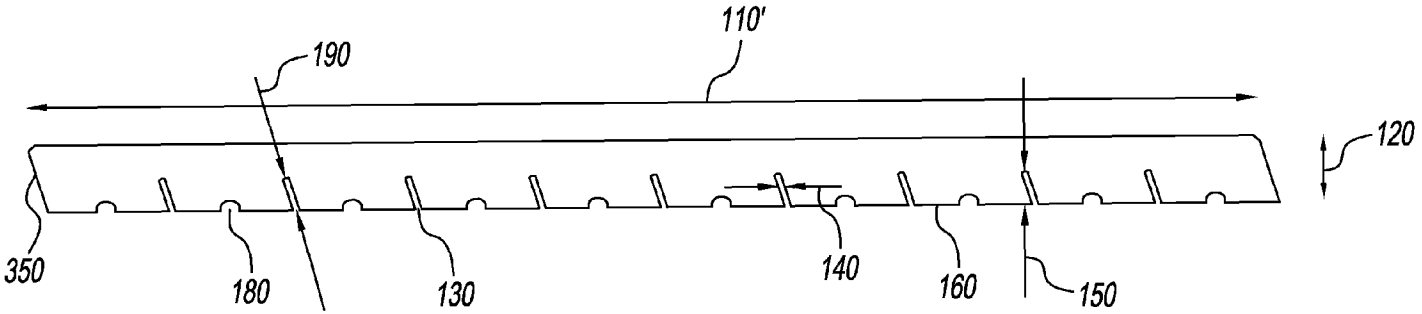
Figure 3F:
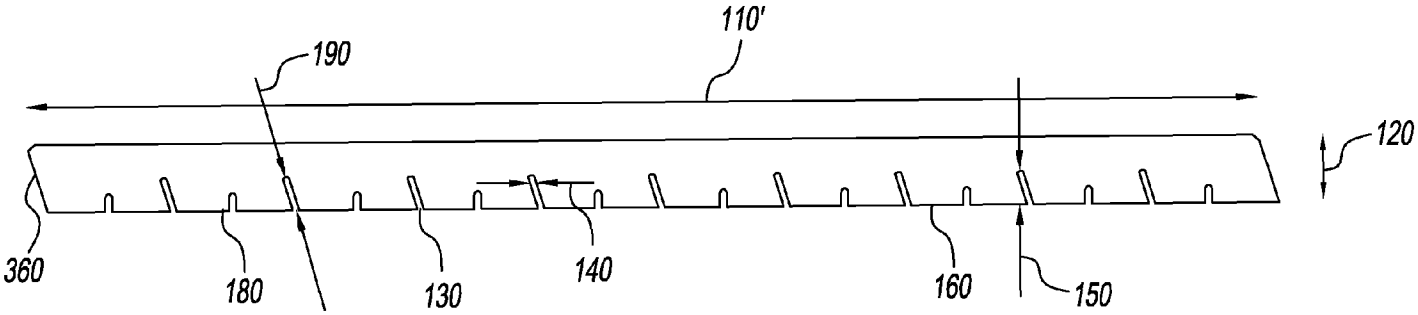

FIGS. 2C and 2D show horizontal partitions 220 and 230 that are generally configured similarly to horizontal partition 210. The difference between in partitions 220 and 230 as compared to horizontal partition 210 is that horizontal partitions 220 and 230 have weep holes 180 and slots 130 disposed along opposite edges of the horizontal partitions, with the weep holes 180 shown in partition 220 being elongated slots and weep holes 180 in horizontal partition 230 being through-holes. The options referred to above in paragraph [0033] with respect to the shape, placement, size and number of through-holes 180 applies equally as well to the through-holes in horizontal partitions 220 and 230. FIGS. 3E and 3F show vertical partitions 350 and 360, respectively, generally similar in design and configuration to vertical partitions 320, 330 and 340, with the difference being that vertical partitions 350 and 360 have through-holes 180 disposed along the same edge as slots 130. And again, similarly, the options available for through-holes 184 vertical partitions 350 and 360 respect to shape, placement, size and number are similar to those options referred to in paragraph [0033].

Turning now to additional configurations of vertical and horizontal partitions as assembled, horizontal partitions 220 and 230 can be used in combination with any of vertical partitions 310, 350 and 360. As will be appreciated, the assembly of either of horizontal partitions 220 or 230 with either of vertical partitions 350 or 360 will result in the configuration having weep holes 180 disposed on all four sides of each ice cube cell of the assembled partition. As will also be appreciated, the assembly of either of horizontal partitions 220 or 230 with vertical partition 310 will result in the configuration having weep holes 180 disposed on the horizontal sides of each ice cube cell of the assembled partition.

As will be understood from the foregoing discussion relating to the optional vertical partitions and horizontal partition combinations of the present disclosure, the present disclosure is concerned with offsetting the placement of weep holes 180 from association with the intersections of vertical partitions and horizontal partitions. The placement of weep holes 180 at the intersections of vertical partitions and horizontal partitions that is the state-of-the-art results in the problems described in the Background portion of this disclosure. Thus, the exemplary embodiments of the present disclosure discussed above eliminate any weep holes 180 from being located at the intersections of the vertical partitions and horizontal partitions, as discussed above. Also, when the offset placement of weep holes 180 allows complete wicking of soldering and/or brazing material into the intersection of the vertical partitions and horizontal partitions, thus eliminating the possibility of incomplete plating at these intersections during the plating process. This also results in reducing the possibility of undercutting the plating by galvanic action.

The present disclosure also contemplates an alternative to offsetting weep holes 180 from the intersections of the vertical partitions and horizontal partitions. This alternative is shown in FIGS. 4A and 4B.

Figure 4A:
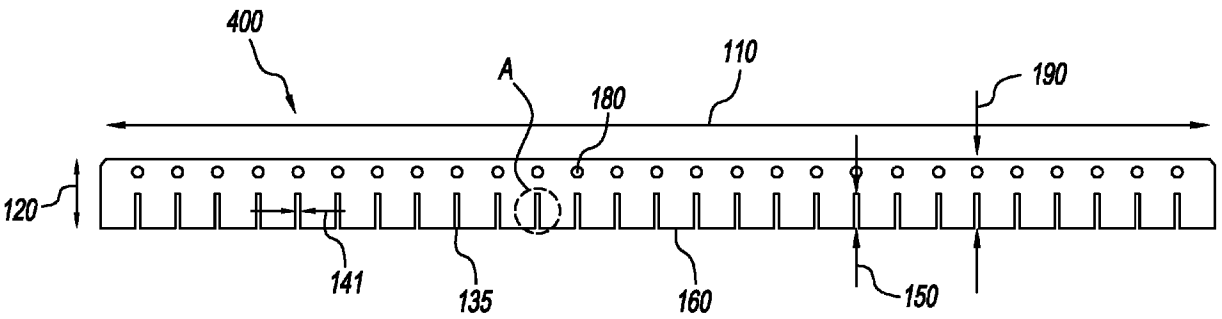
FIG. 4A provides a side view of a stand-off horizontal partition.
Figure 4B:
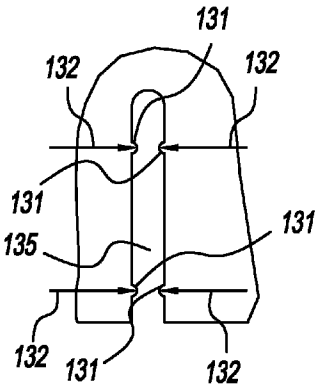
FIG. 4B provides an enlarged view of section "A" of FIG. 4A.
Figure 4C:
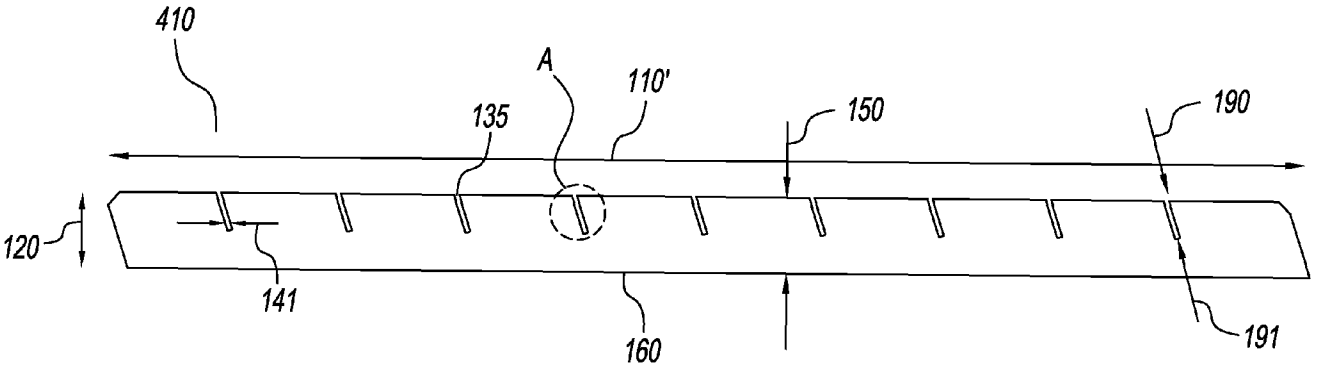
FIG. 4C provides a side view of a stand-off vertical partition.
Figure 4D:
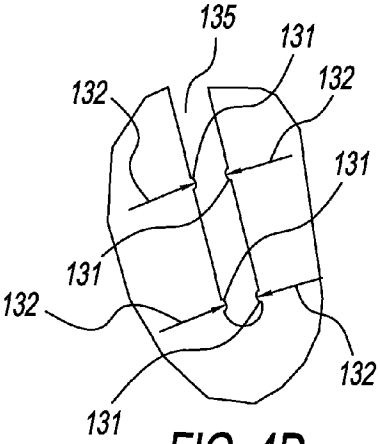
FIG. 4D provides an enlarged view of section "A" of FIG. 4C.

FIG. 4A shows a horizontal partition 400 suitable for use in the alternative embodiment of the present disclosure. Horizontal partition 400 is generally similar to horizontal partition 100 with the exception of two differences. The first difference is that in the embodiment of the alternative shown in FIG. 4A, horizontal partition 400 has weep holes 180 located along centerline 190 of slots 135 and the second difference is that slots 135 have width 141 of a greater dimension than width 140 of slots 130. This difference will be explained in the following discussion. FIG. 4C shows a vertical partition 410 suitable for use in the alternative embodiment of the present disclosure. Vertical partition 410 is generally similar to vertical partition 170 with the exception of two differences. The first difference is that in the embodiment of the alternative shown in FIG. 4C, vertical partition 410 has no weep holes 180 and, as with horizontal partition 400, has slots 135 with width 141 of a greater dimension than width 140 of slots 130. While weep holes 180 are shown on horizontal partition 400, this is a mere matter of design choice for this alternative of the present disclosure. Weep holes 180 could just as well be located on centerline 190 of vertical partition 410. Thus, for purposes of the discussion with respect to this alternative of the present disclosure, the location of weep holes 180 is not critical. The alternative shown in FIGS. 4A and 4C of the present disclosure will be more clearly understood in conjunction with the description of FIGS. 4B and 4D. FIGS. 4B and 4D show one configuration of slots 135 having stand offs or protrusions 131 according to the alternative of the disclosure. Slots 135 are nominally of width 141 that is greater than the nominal outside dimensional width of horizontal partition 400 and vertical partition 410. The nominally greater width 141 of slots 135 avoids the issue of tight or no clearance at the intersections of horizontal partition 400 and vertical partition 410. However, the greater width 141 of slots 135 in horizontal partition 400 and vertical partition 410 would normally have the effect of allowing for movement or "wobble" between horizontal partition 400 and vertical partition 410. To overcome this potential problem, the present disclosure contemplates the inclusion of standoffs or protrusions 131 as seen in FIGS. 4B and 4D. Standoffs or protrusions 131 are separated by a distance 132 which is of tight or no clearance to the actual width of the partition (400 or 410) mated to slot 135. Stated otherwise, the increased width 141 of slot 135 allows for space (represented by the depth of stand offs or protrusions 131 reducing width 141 of slots 135) between the outside surface of horizontal partition 400/vertical partition 410 and width 141. In this configuration, when plating of the assembled vertical partition and horizontal partition grid and evaporator pan is performed, plating solution can easily flow into the space provided by standoffs or protrusions 131 and completely coat horizontal protrusion 400 and vertical partition 410 at the intersections thereof. Although standoffs/protrusions 131 are shown in FIGS. 4B, and 4D, as equally spaced and directly opposite each other on opposing walls of slots 135, other configurations will be apparent to those of skill in the art. For instance, standoffs/protrusions 131, could just as easily alternate in a zigzag pattern on opposite sides of the inner wall of slot 135. The effect sort to be attained by standoffs/protrusions 131 is to stabilize the mated partition in slot 135, yet allow substantially complete exposure of the surface of the mated partition to the plating solution.

It should be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A partition for use in forming a crisscross grid capable of substantially completely contacting a substantially planar surface of an evaporator pan of an ice making machine, wherein the crisscross grid is comprised of a plurality of the partitions mated substantially perpendicularly to each other at a plurality of intersections, the partition comprising:

a length having two opposed edges;

a height;

a width;

a plurality of substantially parallel slots disposed along a first one of the edges, wherein each slot has a centerline, and wherein each slot has a dimension that provides tight clearance at each of the plurality of intersections with its mated partitions to provide a capillary path at each of the plurality of intersections and at the contact area of the evaporator pan and each of the plurality of intersections; and at least one weep hole disposed at a location selected from the group consisting of proximal a second one of the edges and not disposed along a centerline and along the first one of the edges between two of the parallel slots.

2. A crisscross grid capable of substantially completely contacting a substantially planar surface of an evaporator pan of an ice making machine, the grid comprised of:

a first plurality of substantially parallel partitions, each partition comprising a length having two opposed edges, a height, a width and a plurality of substantially parallel slots disposed along a first one of the edges, each slot having a centerline, and at least one weep hole disposed at a location selected from the group consisting of proximal a second one of the edges and not disposed along a centerline and along the first one of the edges between two of the parallel slots; and is going on a second plurality of substantially parallel partitions, each partition comprising a length having two opposed edges, a height, a width and a plurality of substantially parallel slots disposed along a first one of the edges, wherein the first and second plurality are mated substantially perpendicularly to one another by engagement of the slots to provide the crisscross grid having a plurality of intersections, and wherein each slot has a dimension that provides tight clearance at each of the plurality of intersections with its mated partition to provide a capillary path at each of the plurality of intersections and at the contact area of the evaporator pan and each of the plurality of intersections.

3. The crisscross grid according to claim 2, wherein each partition of the second plurality of substantially parallel partitions further comprises at least one weep hole disposed along the first one of the edges between two of the parallel slots.

4. A partition for use in forming a crisscross grid, the partition comprising:

a length having two opposed edges;

a height;

a partition width; and a plurality of substantially parallel slots disposed along a first one of the edges, each slot having a first slot width wider than the partition width of a partition disposed therein for forming the crisscross grid, and each slot having at least two protrusions disposed on opposite sides inside of the slot width, wherein the protrusions provide the slot with a second slot width substantially equal to the partition width of a partition disposed therein for forming the crisscross grid.

5. The partition according to claims 4, wherein each slot has a centerline and at least one weep hole disposed proximal a second one of the edges along the centerline.

6. A crisscross grid comprised of:

a first plurality of substantially parallel partitions, each partition comprising a length having two opposed edges, a height, a partition width and a plurality of substantially parallel slots disposed along a first one of the edges, each slot having a centerline and at least one weep hole disposed proximal a second on of the edges along the centerline, each slot having a first slot width wider than the partition width of a partition disposed therein for forming the crisscross grid, and each slot having at least two protrusions disposed on opposite sides inside of the slot width, wherein the protrusions provide the slot with a second slot width substantially equal to the partition width of a partition disposed therein for forming the crisscross grid; and a second plurality of substantially parallel partitions, each partition comprising a length having two opposed edges, a height, a partition width, and a plurality of substantially parallel slots disposed along a first one of the edges, each slot having a first slot width wider than the partition width of a partition disposed therein for forming the crisscross grid, and each slot having at least two protrusions disposed on opposite sides inside of the slot width, wherein the protrusions provide the slot with a second slot width substantially equal to the partition width of a partition disposed therein for forming the crisscross grid, wherein the first and second plurality are disposed substantially perpendicular to one another by engagement of the slots.

7. A method of fabricating an evaporator plate for an ice making machine comprising:

providing a substantially planar evaporator pan;

providing a crisscross grid comprised of:

a first plurality of substantially parallel partitions, each partition comprising a length having two opposed edges, a height, a width and a plurality of substantially parallel slots disposed along a first one of the edges, each slot having a centerline, and at least one weep hole disposed at a location selected from the group consisting of proximal a second one of the edges and not disposed along a centerline and along the first one of the edges between two of the parallel slots; and a second plurality of substantially parallel partitions, each partition comprising a length having two opposed edges, a height, a width and a plurality of substantially parallel slots disposed along a first one of the edges, wherein the first and second plurality are mated substantially perpendicularly to one another by engagement of the slots to provide the crisscross grid having a plurality of intersections, wherein each slot has a dimension that provides tight clearance at each of the plurality of intersections with its mated partition to provide a capillary path at each of the plurality of intersections and at the contact area of the evaporator pan and each of the plurality of intersections; and joining the crisscross grid to the evaporator pan by soldering/brazing, wherein soldering/brazing material substantially completely wicks into points of contact at the plurality of intersections between the first and second plurality and the contact area of the evaporator pan and each of the plurality of intersections.

8. A method of fabricating an evaporator plate for an ice making machine comprising:

providing a substantially planar evaporator pan;

providing a crisscross grid comprised of:

a first plurality of substantially parallel partitions, each partition comprising a length having two opposed edges, a height, a partition width and a plurality of substantially parallel slots disposed along a first one of the edges, each slot having a centerline and at least one weep hole disposed proximal a second on of the edges along the centerline, each slot having a first slot width wider than the partition width of a partition disposed therein for forming the crisscross grid, and each slot having at least two protrusions disposed on opposite sides inside of the slot width, wherein the protrusions provide the slot with a second slot width substantially equal to the partition width of a partition disposed therein for forming the crisscross grid; and a second plurality of substantially parallel partitions, each partition comprising a length having two opposed edges, a height, a partition width, and a plurality of substantially parallel slots disposed along a first one of the edges, each slot—having a first slot width wider than the partition width of a partition disposed therein for forming the crisscross grid, and each slot having at least two protrusions disposed on opposite sides inside of the slot width, wherein the protrusions provide the slot with a second slot width substantially equal to the partition width of a partition disposed therein for forming the crisscross grid, and wherein the first and second plurality are disposed substantially perpendicular to one another by engagement of the slots; and joining the crisscross grid to the evaporator pan by soldering/brazing, wherein soldering/brazing material substantially completely joins points of contact between the first and second plurality and points of contact between the first and second plurality and the evaporator pan.

* * * * *